US008474289B2

(12) United States Patent
Solomon

(10) Patent No.: US 8,474,289 B2
(45) Date of Patent: Jul. 2, 2013

(54) LOCKING SYSTEMS

(75) Inventor: Arnold Cory Solomon, Covington, GA (US)

(73) Assignee: Southern Company Services, Inc., Atlanta, GA (US)

( * ) Notice: Subject to any disclaimer, the term of this patent is extended or adjusted under 35 U.S.C. 154(b) by 0 days.

(21) Appl. No.: 13/305,364

(22) Filed: Nov. 28, 2011

(65) Prior Publication Data

US 2013/0133383 A1 May 30, 2013

(51) Int. Cl.
*E05B 67/36* (2006.01)

(52) U.S. Cl.
USPC ..... 70/34; 70/386; 70/389; 70/390

(58) Field of Classification Search
USPC ..... 70/32–34, 386, 389, 390
See application file for complete search history.

(56) References Cited

U.S. PATENT DOCUMENTS

| | | | | |
|---|---|---|---|---|
| 1,728,612 | A * | 9/1929 | Johnson | 70/39 |
| 3,509,748 | A * | 5/1970 | Trainor | 70/491 |
| 3,729,964 | A | 5/1973 | Hsu | |
| 3,906,762 | A | 9/1975 | Austin et al. | |
| 4,058,992 | A * | 11/1977 | Nielsen, Jr. | 70/34 |
| 4,109,496 | A | 8/1978 | Allemann et al. | |
| 4,155,232 | A * | 5/1979 | Haus, Jr. et al. | 70/34 |
| 4,228,669 | A | 10/1980 | Bischoff | |
| 4,394,820 | A * | 7/1983 | Swisher | 70/34 |
| 4,441,348 | A * | 4/1984 | Neilsen | 70/389 |
| 4,448,051 | A * | 5/1984 | Neilsen | 70/389 |
| 4,570,469 | A * | 2/1986 | Neilsen | 70/389 |
| 4,662,199 | A * | 5/1987 | Neilsen | 70/389 |
| 5,027,624 | A | 7/1991 | Agbay et al. | |
| 5,079,935 | A | 1/1992 | Zaucha | |
| 5,823,030 | A | 10/1998 | Theriault et al. | |
| 5,970,761 | A | 10/1999 | Eden, Jr. | |
| 6,546,768 | B1 | 4/2003 | Burghoff et al. | |
| 6,684,670 | B1 * | 2/2004 | Agbay et al. | 70/164 |
| 7,334,441 | B1 * | 2/2008 | Amundson et al. | 70/252 |
| 7,650,767 | B2 * | 1/2010 | Robinson | 70/34 |
| 7,775,071 | B2 * | 8/2010 | Agbay | 70/34 |
| 2007/0193318 | A1 | 8/2007 | Churchill et al. | |
| 2010/0171326 | A1 | 7/2010 | Bacon | |

FOREIGN PATENT DOCUMENTS

| | | |
|---|---|---|
| GB | 190904129 | 2/1909 |
| GB | 657386 | 9/1951 |
| WO | 2008050464 | 2/2008 |

* cited by examiner

*Primary Examiner* — Suzanne Barrett
(74) *Attorney, Agent, or Firm* — Thomas Horstemeyer, LLP

(57) ABSTRACT

Disclosed are various embodiments of locking systems that include a barrel lock. The barrel lock is configured to damage, deface, and/or capture a key that is inserted into the barrel lock. Additionally, some embodiments include a locking mechanism adapter that can allow the locking mechanism to be operated by a key if the user has knowledge about the properties of the barrel lock.

18 Claims, 9 Drawing Sheets

LOCKING SYSTEMS

BACKGROUND

Barrel locks are widely employed in the utility industry to secure and/or restrict access to utility meters that are installed at a customer premises and/or other utility infrastructure. Because barrel locks can be employed in the utility industry, a situation can arise such that many copies of a key that can be used to access any barrel locks deployed by the utility are in circulation. Accordingly, these keys can be lost, stolen and/or misplaced and used to gain unauthorized access to utility meters and/or other utility infrastructure.

SUMMARY OF THE INVENTION

Embodiments of the disclosure include various locking systems and methods. One embodiment includes a cylindrical barrel lock having a first end with an aperture, the cylindrical barrel lock having an inner shaft. The embodiment also includes at least one locking ball aperture configured to accept at least one respective locking ball, the at least one locking ball aperture extending through the inner shaft and positioned along a surface of the cylindrical barrel lock, the at least one locking ball configured to extend through the at least one locking ball aperture. The embodiment also includes a locking mechanism configured to cause the at least one respective locking ball to be positioned in a locked position and an unlocked position. The embodiment also includes a key disabling device positioned within the inner shaft, the key disabling device configured to perform at least one of: disabling of a target key inserted into the aperture and capturing of the target key inserted into the aperture.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Embodiments of the disclosure are directed to locking systems comprising a barrel lock configured to capture, damage, deface, and/or destroy certain keys that are attempted to be used with the locking systems disclosed herein. As noted above, in the utility industry, barrel locks can be employed to secure access to utility meters or other utility infrastructure in a utility distribution and metering environment. To address the realities of a potentially disparate workforce needing on-demand access to potentially disparately located utility infrastructure, these barrel locks can often be accessed by a key according to a common design that is possessed by potentially hundreds and/or thousands of personnel. Accordingly, as these keys can be lost, stolen, or even copied, unauthorized access to utility infrastructure can proliferate as more and more keys to utility barrel locks also proliferates.

Therefore, embodiments of the disclosure are directed to locking systems including barrel locks that appear to be traditional barrel locks that can be opened by one of these keys. However, a barrel lock according to the disclosure can instead damage and/or capture a barrel lock key that inserted into an inner shaft of the barrel lock. Accordingly, reference is now made to FIG. 1, which illustrates a barrel lock 100 according to an embodiment of the disclosure. The depicted barrel lock 100 is configured with a first end having an aperture 104 through which a key can be inserted into an inner shaft of the barrel lock 100.

The barrel lock 100 also comprises at least one locking ball 106 that is configured to be positioned by a locking mechanism within the inner shaft of the barrel lock 100 in a locked and/or unlocked position. The at least one locking ball 106 is configured to extend through the exterior surface of the barrel lock 100 and into the inner shaft of the barrel lock 100. The operation of the at least one locking ball 106 in conjunction with a locking mechanism of the barrel lock 100 will be shown in greater detail in subsequent drawings. Although, in the context of the present disclosure, at least one locking ball 106 is shown with a barrel lock 100 according to the various embodiments, it should be appreciated that other types of mechanisms can be employed in the place of a locking ball to achieve the same effect. For example, instead of a locking ball, one or more plungers, pegs, or devices of other shapes and sizes can be employed to extend and/or retract through one or more sides of the exterior surface of the barrel lock 100 and in conjunction with an internal locking mechanism as shown in the subsequent drawings. Accordingly, as shown in FIG. 1, although the barrel lock 100 is configured to capture, damage, or deface keys that may be lost or stolen, its exterior appearance is similar to a barrel lock that does not possess this ability.

Figure 1:
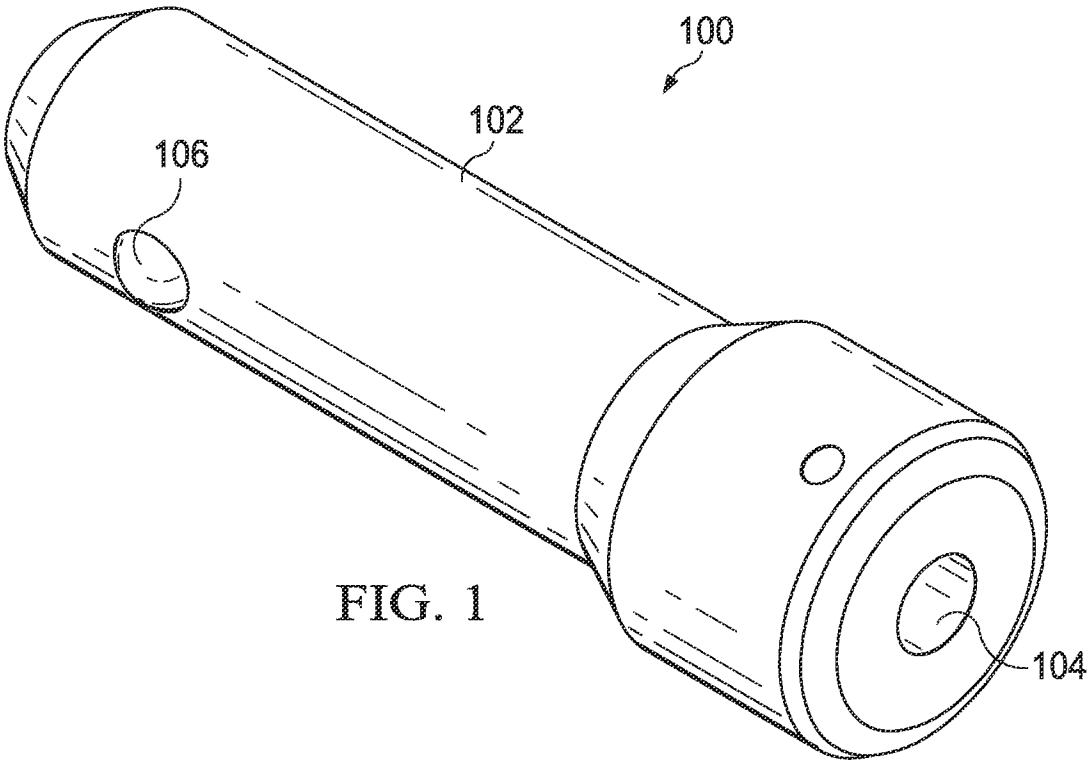
FIG. 1 is a drawing of a barrel lock according to various embodiments of the present disclosure.
Figure 2:
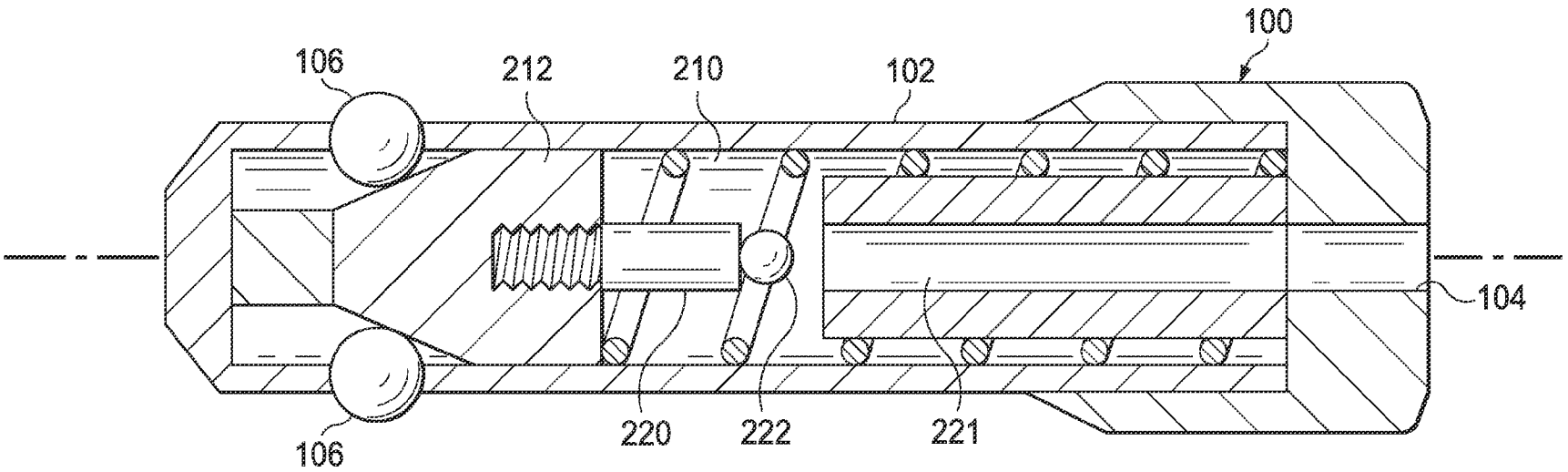
FIG. 2 is a cross-sectional view of the barrel lock of FIG. 1 according to various embodiments of the disclosure.

Reference is now made to FIG. 2, which illustrates a cross-sectional view of a locking system including a barrel lock 100 of FIG. 1. In the depicted embodiment, at least one locking ball 106 can extend through an inner shaft 210 of the barrel lock 100. A locking mechanism 212 causes the locking balls 106 to be positioned in a locked position and an unlocked position depending on whether the locking mechanism is positioned such that the locking balls 106 extend outside the shaft of the barrel lock 100 (locked) or retract inside the inner shaft 210 of the barrel lock 100 (unlocked).

The barrel lock 100 also includes key disabling device that, in the depicted embodiment, comprises a bait device 220 that facilitates capture and/or damage of a key that is inserted through an inner sleeve 221 in the inner shaft 210 of the barrel lock 100. In the depicted example, the bait device 220 also comprises a bait plunger 222 that is configured to engage a key inserted through the aperture 104 and the inner sleeve 221 of the barrel lock 100. The aperture 104 can be configured with a shroud or other device to restrict moisture from entering the inner shaft 210. Such a shroud can also serve to limit visibility into the inner shaft 210 as well as detectability of the specific features of the barrel lock 100. A shroud can also inhibit the bait device 220 from falling out of the barrel lock 100.

The bait plunger 222 engages a gripper mechanism of a barrel lock key, which is a standard configuration for many forms of barrel lock keys and a potentially likely configuration of a key that has been lost, stolen or misplaced. Accordingly, an entity employing the barrel lock 100 shown in FIG. 2 may have a desire to capture, damage, deface, or disable such a key. The bait device 220 is installed and/or inserted into the inner shaft 210 of the barrel lock 100 in such a way so that the locking mechanism 212 is not operated. In other words, in some embodiments, the bait device 220 is not rigidly coupled to the locking mechanism 212. In some embodiments, the bait device 220 can comprise a ferromagnetic material, a paramagnetic material, and/or any combination thereof such that it can be loosely placed within the inner shaft 210 of the barrel lock 100 and removed with an appropriately sized magnetic device inserted through the inner shaft 210. Additionally, although the particular bait plunger 222 illustrated in the drawing is in the shape of a ball, it should also be appreciated that a cylindrically shaped bait device or any other shape to which a key inserted through the inner shaft 210 can engage.

Figure 3:
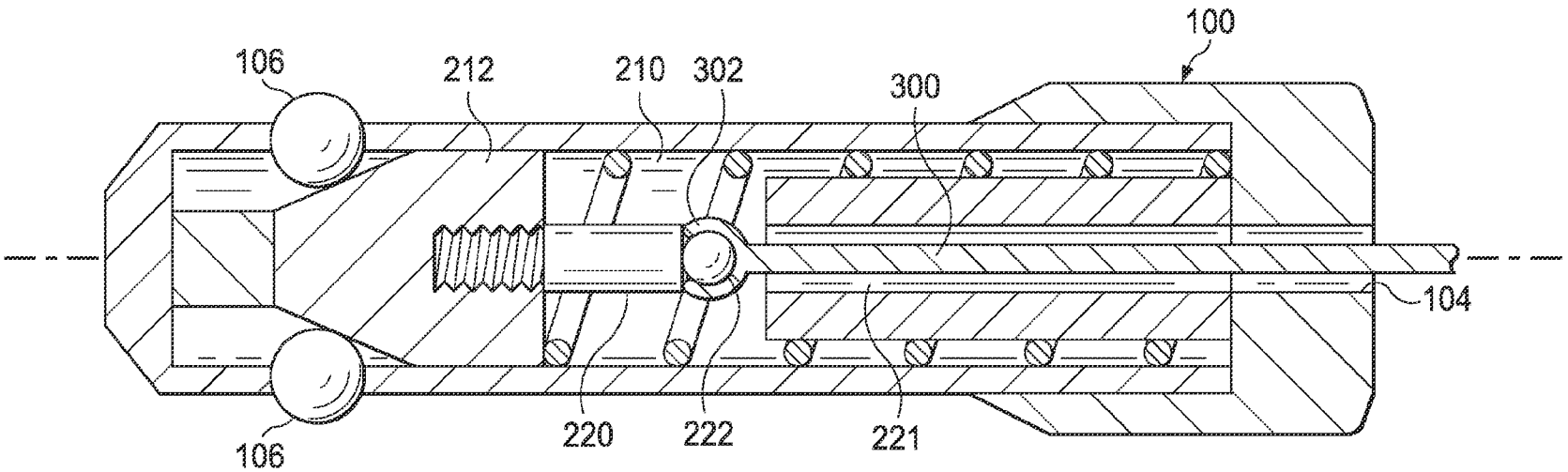
FIG. 3 is a cross-sectional view of the barrel lock of FIG. 1 according to various embodiments of the disclosure showing a key inserted in the inner shaft of the barrel lock.

Reference is now made to FIG. 3, which illustrates an example of a locking system including a barrel lock 100 according to an embodiment of the disclosure. FIG. 3 illustrates how a barrel lock 100 according the disclosure can capture, disable and/or damage a key 300 inserted through the inner sleeve 221 of the barrel lock 100. When the key 300 is inserted, a gripping mechanism 302 of the key 300 engages the bait device 220. In the depicted example, the gripping mechanism 302 of the key 300 engages the bait plunger 222, which causes the gripping mechanism 302 to expand in order to complete engagement of the bait device 220 and key 300. In prior art barrel locks, the gripping mechanism 302 of the key 300 engages a plunger associated with and/or coupled to a locking mechanism, which allows the locking mechanism to be operated. However, in the depicted barrel lock 100, the gripping mechanism 302 of the key 300 engages the bait device 220, which does not allow the locking mechanism to be operated.

The engaging of the bait plunger 222 by a key 300 causes the circumference of the key 300 to expand. In other words, the circumference of the inner sleeve 221 allows the gripping mechanism 302 of the key 300 to be inserted through the inner sleeve 221 and engage the bait plunger 222. However, the circumference of the gripping mechanism 302 upon engaging the bait device 222 becomes greater than the inner circumference of the inner sleeve 221, which can prevent removal of the key 300 from the inner sleeve 221. Therefore, a user attempting to use a key 300 with a gripping mechanism 302 that engages the bait plunger 222 potentially damages the key 300 by attempting to retract the key 300 through the inner sleeve 221. Or, the user may abandon the key 300 with the gripping mechanism 302 engaged with the bait plunger 222 upon finding that removal of the key 300 is restricted and/or impossible without much effort.

In some embodiments, rather than sizing the inner sleeve 221 such that its circumference is less than a circumference of the gripping mechanism 302 upon engagement with the bait plunger 222, the inner sleeve 221 can be configured with one or more defacing and/or capturing mechanisms that damage and/or capture a key 300 inserted through the inner sleeve 221. In one embodiment, the inner sleeve 221 can be configured with hardened metal blades, teeth and/or any other mechanisms or structures made of a suitable material that can damage the key 300 as the user attempts to retract the key 300 through the inner sleeve 221 and out of the aperture 104 of the barrel lock 100.

Figure 4:
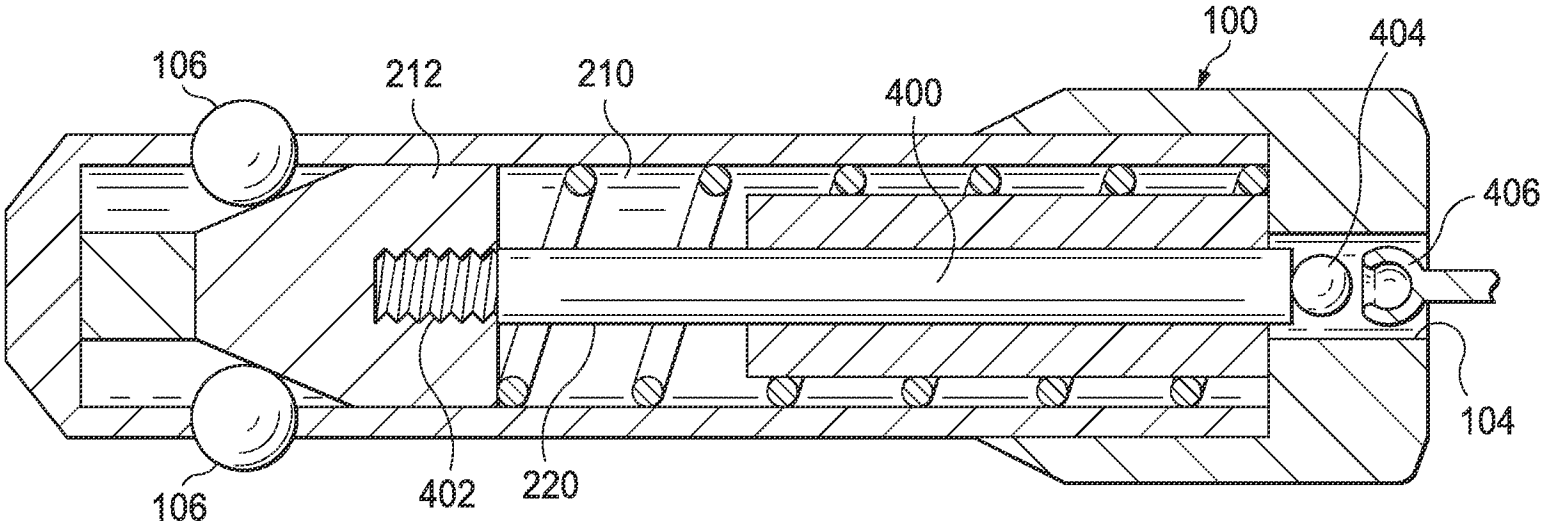
FIGS. 4-5 are cross-sectional view of the barrel lock of FIG. 1 according to various embodiments of the disclosure showing one way in which the barrel lock can be operated.

Reference is now made to FIG. 4, which illustrates one way in which the barrel lock 100 can be unlocked without capturing and/or damaging a key. In other words, FIG. 4 illustrates one way in which a legitimate user can operate the barrel lock 100 according to one embodiment of the disclosure. In the example of FIG. 4, the bait device 220 can be removed from the inner shaft 210 of the barrel lock 100. In one example, the bait device 220 can be removed with a magnetic device if the bait device 220 comprises a ferromagnetic, paramagnetic, magnetic, or any other material that facilitates removal with a magnetic instrument. Accordingly, an unlocking device adapter 400 can then be inserted through the inner sleeve 221 to engage the locking mechanism 212. In this example, the unlocking device adapter 400 can engage the locking mechanism 212 via a threaded aperture 402 that is coupled to the locking mechanism 212. It should be appreciated that some embodiments of a barrel lock 100 according to the disclosure can be configured without a threaded aperture 402 or other mechanisms facilitating unlocking by a legitimate user. Such a barrel lock 100 may also be configured without an unlocking mechanism 212. In this sense, such a barrel lock 100 can be considered a one-time use device that is tailored to capture and/or damage a key inserted through the inner shaft 210 that engages the bait device 220.

Figure 5:
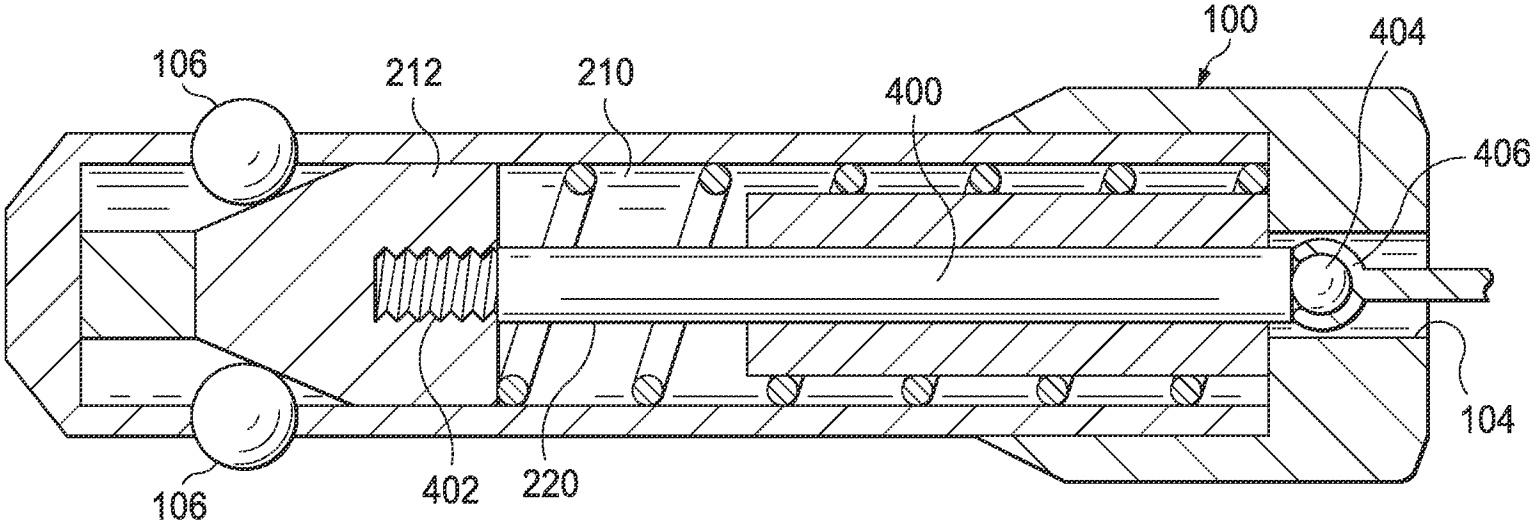

In some embodiments, the threaded aperture 402 can comprise a reverse threaded aperture to improve security of the barrel lock 100. In such an embodiment, by employing a reverse threaded aperture, only a user with knowledge of the existence of the threaded aperture 402 as well as the fact that it is reverse threaded can operate the locking mechanism 212. Accordingly, a first end of the unlocking device adapter 400 can be configured to be compatible with the threaded aperture 402. The unlocking device adapter 400 can then be screwed into the threaded aperture 402. Additionally, the unlocking device adapter 400 can include another end that comprises a plunger 404 to which a key 406 operated by the legitimate user can engage. In this way, the same and/or similar key that is employed throughout a deployment and distributed to personnel can be used to operate the locking mechanism 212, but only potentially by those with knowledge of the properties of the barrel lock 100. Accordingly, in FIG. 5, engagement of the key 406 with the plunger 404 of the unlocking device adapter 400 is shown. In this way, the barrel lock 100 can be operated without damaging, defacing and/or capturing the key 406 and/or unlocking device adapter 400, as the bait device 220 is not present, and the unlocking device adapter 400 allows operation of the locking mechanism 212 with the key 406.

Figure 6:
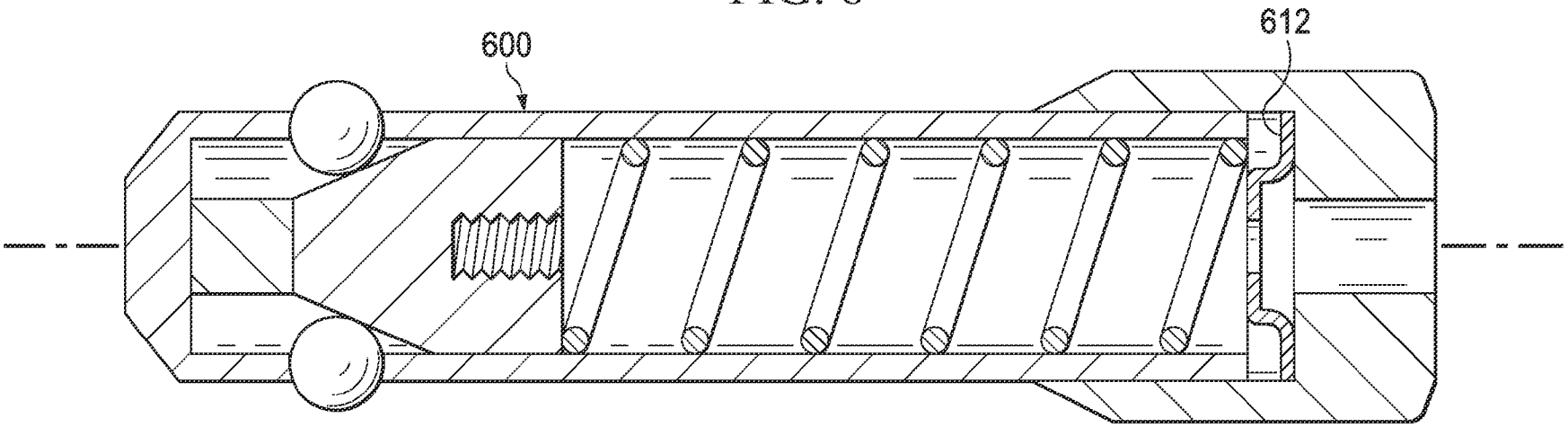
FIG. 6 is an alternative embodiment of a barrel lock according to various embodiments of the disclosure.

Reference is now made to FIG. 6, which illustrates an alternative embodiment of a barrel lock 100 according to the disclosure. In the example of FIG. 6, the key disabling device can comprise a lock nut 612 that is configured to damage, capture and/or deface a key that is inserted into the inner shaft of the barrel lock 600. In the depicted example, the lock nut 612 can be configured with a circumference that is similar and/or smaller than a key that is inserted into the inner shaft. Therefore, the lock nut 612 can capture and/or otherwise disable a key by preventing or restricting removal of the key from the inner shaft of the barrel lock 600.

In one example, the lock nut 612 can be configured such that an opening of the lock nut 612 is concave relative to the insertion point of the key. Additionally, the lock nut 612 can include one or more key defacing mechanisms or instruments oriented away from the insertion point of the key so that, if a user attempts to extract the key from the barrel lock 600, the key is captured and/or damaged by the key defacing mechanisms. These key defacing mechanisms can include one or more hardened teeth, blades, or other instruments that can damage and/or capture the key. Additionally, because they can be oriented away from the key insertion point, they can inflict sufficient damage upon the key as it is attempted to be removed from the barrel lock 600. In the example of FIG. 6, the locking mechanism can be operated with an unlocking device adapter as described above. The unlocking device adapter can be sized such that it is not captured and/or damaged by the lock nut as it is inserted into the inner shaft of the barrel lock 600.

Figure 7:
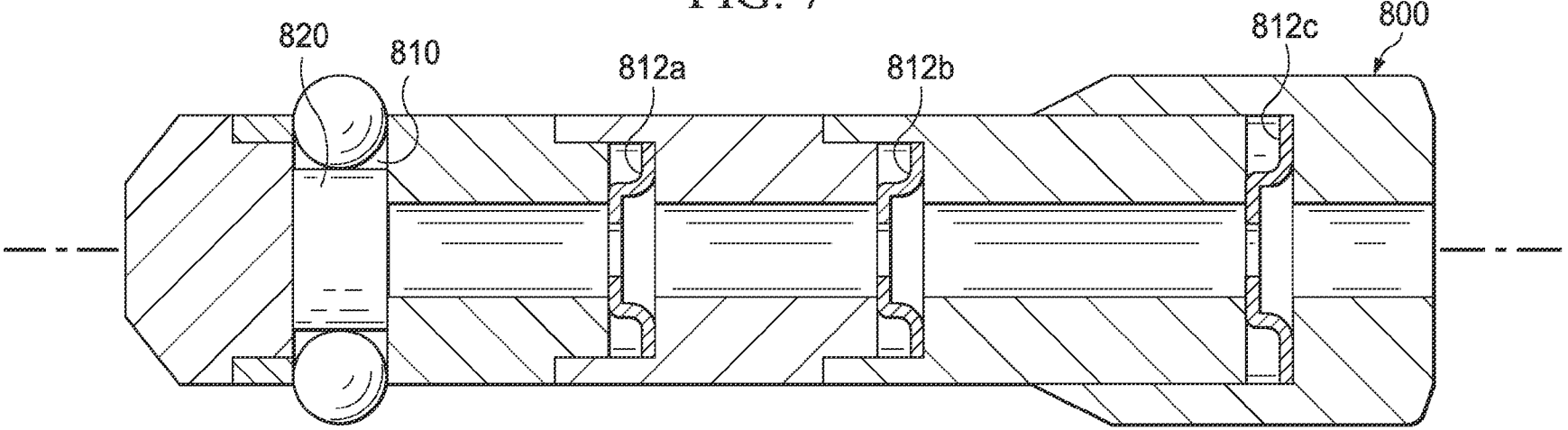
FIG. 7 is an alternative embodiment of a barrel lock according to various embodiments of the disclosure.

Reference is now made to FIG. 7, which illustrates an alternative embodiment of a barrel lock 800 according to an embodiment of the disclosure. In the embodiment shown in FIG. 7, the barrel lock 800 can include multiple key defacing devices 812 disposed within the inner shaft of the barrel lock 800. In the example of FIG. 7, the barrel lock 800 can include multiple lock nuts 812 disposed within the inner shaft of the barrel lock 800 such that as a key is inserted the various key defacing devices 812*a*, 812*b*, 812*c* can each restrict and/or prevent extraction of the key from the barrel lock 800. Additionally, the key defacing devices 812*a*, 812*b*, 812*c* can also damage a key as it is inserted and/or as a user attempts to remove the key from the inner shaft.

Figure 8:
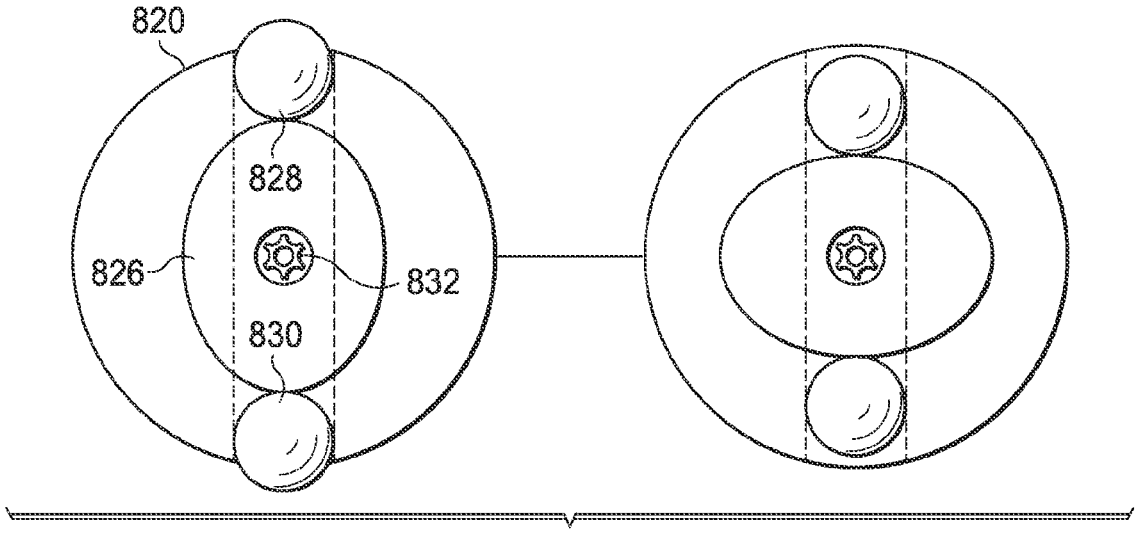
FIG. 8 is an alternative embodiment of a locking mechanism of a barrel lock according to various embodiments of the disclosure

FIG. 7 also illustrates an alternative locking mechanism 820 that can be employed in a barrel lock according to an embodiment of the disclosure to further increase security of the lock. In the example of FIG. 8, the locking mechanism can be configured to be incompatible with a legacy key that may be used to attempt to open the lock. Accordingly, such a key can be damaged and/or captured by the key defacing mechanisms 812 as well as be inoperable to operate the locking mechanism 820.

Continuing the example of FIG. 7, reference is now made to FIG. 8, which illustrates such an alternative locking mechanism 820. In the depicted example, the locking mechanism 820 comprises a locking cam 826 that is configured to cause the locking balls 828, 830 to extend and/or retract from an inner shaft of the barrel lock 800. Additionally, the locking mechanism 820 can include a security mechanism 832 that requires a key configured to engage the security mechanism 832 in order to operate the locking mechanism 820. Accordingly, in addition to a bait device, key defacing mechanism, or any other key capturing and/or damaging mechanisms disclosed herein, a barrel lock according to an embodiment of the disclosure can also include such a locking mechanism 820 so that only personnel possessing a key configured to property engage and/or operate the security mechanism 832 can gain access to a resource secured by the barrel lock. Additionally, although a particular type of security mechanism 832 is shown, it should be appreciated that the security mechanism 832 can comprise any standard or specialized aperture, keyhole, or other device to which a key can engage.

Figure 9A:
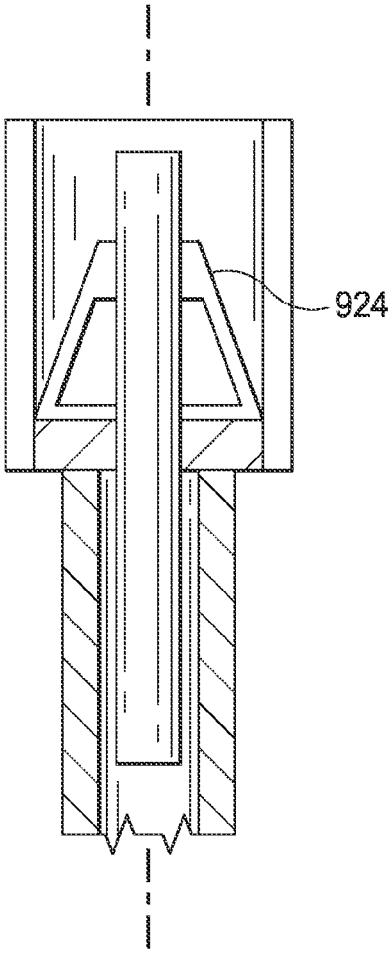
FIGS. 9A-9B illustrate an alternative embodiment of a barrel lock according to various embodiments of the disclosure.
Figure 9B:
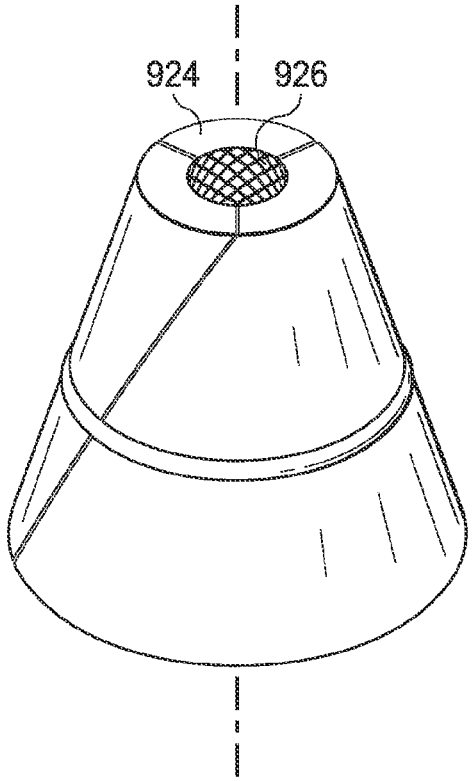

Reference is now made to FIGS. 9A-9B, which illustrate an alternative example of a barrel lock according to an embodiment of the disclosure. In the example shown in FIGS. 9A-9B, an alternative key disabling device is shown. In this example, the key disabling device can comprise a wedge 924 (e.g., a conical wedge) that is configured to convert an insertion and/or withdrawal force (i.e. a force imparted onto the key to insert and/or remove the key) into a clamping force when a key is inserted through the wedge 924 disposed in the inner shaft of a barrel lock. An interior 926 of the wedge 924 can also be configured with one or more key defacing mechanisms, such as hardened teeth, spikes, or other mechanisms that can damage a key inserted through the wedge 924. Accordingly, as a user attempts to insert and/or remove a key through the wedge 924, the wedge 924 can convert the force applied to the key to a force that damages, captures, and/or otherwise disables the key.

Figure 10:
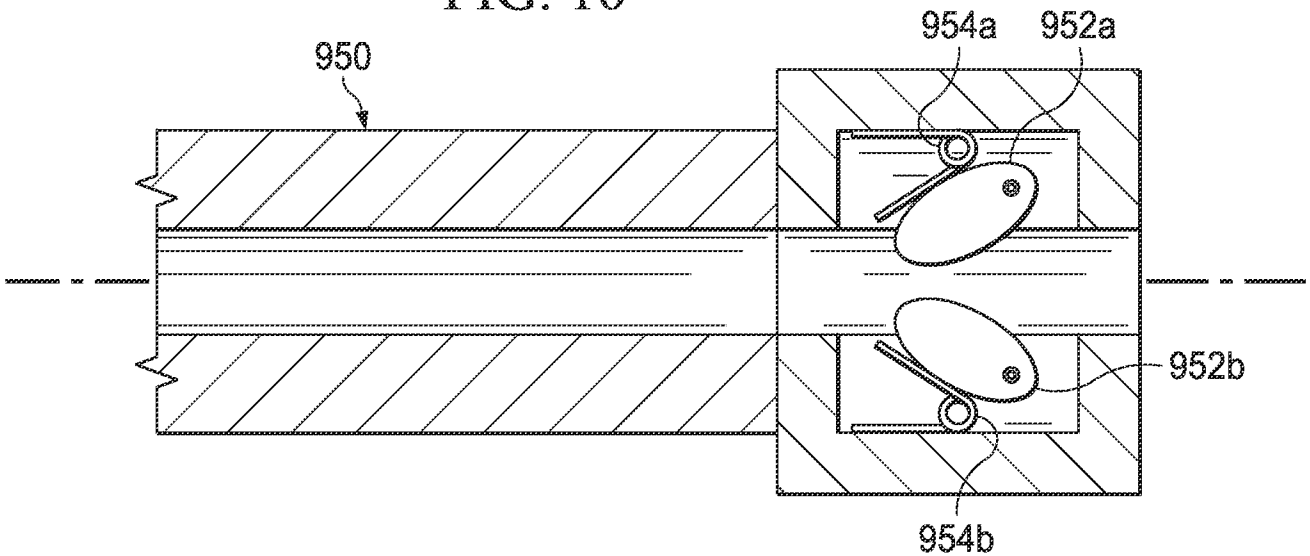
FIG. 10 is an alternative embodiment of a barrel lock according to various embodiments of the disclosure.

Reference is now made to FIG. 10, which illustrates yet another embodiment of a barrel lock 950 according to the disclosure. In the depicted embodiment, the barrel lock 950 includes an alternative embodiment of a key disabling device 952 that can be configured to capture and/or damage a key inserted into the inner shaft of the barrel lock 950.

The depicted example illustrates a pair of locking cams positioned on opposing sides of the inner shaft of barrel lock 950. Additionally, respective positioning springs 954 can also be positioned on opposing sides of the inner shaft to maintain proper positioning of the locking cams on opposing sides of the inner shaft. The locking cams can target the shank of a key inserted into the inner shaft of the barrel lock and converting an insertion and/or removal force to a lateral force that can distort and/or damage a gripping mechanism or other part of the key. The key disabling device 952 can be positioned at or near an aperture of the barrel lock 950 providing access to the inner shaft. The key disabling device 952 can also comprise sharpened locking plates in place of the locking cams, which can convert an insertion and/or removal force into a lateral force that can also target the shank and/or gripping mechanism of a key such that it is damaged and/or defaced. No matter the particular type of key disabling device 952 chosen in the embodiment of FIG. 10, it can be configured to convert an insertion and/or removal force into a lateral force that damages, captures and/or disables a key inserted into the inner shaft of the barrel lock 950.

A locking system according to an embodiment of the disclosure can include a barrel lock according to the disclosure that is paired with a locking ring to secure a utility meter. A barrel lock according to an embodiment of the disclosure can also be configured to secure any resource as with prior art barrel lock. It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A locking system, comprising:

a cylindrical barrel lock having a first end with an aperture, the cylindrical barrel lock having an inner shaft;

at least one locking ball aperture configured to accept at least one respective locking ball, the at least one locking ball aperture extending through the inner shaft and positioned along a surface of the cylindrical barrel lock, the at least one locking ball configured to extend through the at least one locking ball aperture;

a locking mechanism configured to cause the at least one respective locking ball to be positioned in a locked position and an unlocked position, the locking mechanism rigidly coupled to a threaded aperture; and an inner sleeve positioned within the inner shaft, the inner sleeve configured to accept a target key in the inner shaft via the aperture, wherein a first end of the inner sleeve is positioned adjacent to the aperture;

a bait device positioned adjacent to a second end of the inner sleeve, the bait device comprising a bait plunger configured to be engaged by a gripping mechanism of the target key, wherein the bait device comprises at least one of a ferromagnetic and a paramagnetic material, wherein the inner sleeve is configured with a first circumference allowing insertion of the target through the inner sleeve to engage the bait device, the first circumference being less than a circumference of the gripping mechanism upon engagement of the gripping mechanism with the bait plunger, the bait device further being positioned between the threaded aperture and the aperture on the first end of the cylindrical barrel lock; wherein the threaded aperture is configured to engage an adapter pin inserted through the inner sleeve, the adapter pin having a first end that is compatible with the threaded aperture and a second end configured to engage another key exterior to the inner sleeve and adjacent to the first end of the inner sleeve.

2. The locking system of claim 1, wherein the adapter pin allows operation of the locking mechanism by the other key engaged to the second end of the adapter pin.

3. A locking system, comprising:

a cylindrical barrel lock having a first end with an aperture, the cylindrical barrel lock having an inner shaft;

at least one locking ball aperture configured to accept at least one respective locking ball, the at least one locking ball aperture extending through the inner shaft and positioned along a surface of the cylindrical barrel lock, the at least one locking ball configured to extend through the at least one locking ball aperture;

a locking mechanism configured to cause the at least one respective locking ball to be positioned in a locked position and an unlocked position; and a key disabling device positioned within the inner shaft, the key disabling device configured to perform at least one of: disabling of a target key inserted into the aperture or capturing of the target key inserted into the aperture, the key disabling device further comprising:

an inner sleeve positioned within the inner shaft, the inner sleeve configured to accept the target key in the inner shaft via the aperture, wherein a first end of the inner sleeve is positioned adjacent to the aperture; and a bait device positioned adjacent to a second end of the inner sleeve, the bait device configured to be engaged by a gripping mechanism of the target key; wherein the inner sleeve is configured with a first circumference that is less than a second circumference associated with the gripping mechanism when the gripping mechanism engages the bait device.

4. The locking system of claim 3, wherein the bait device further comprises a bait plunger, the bait plunger further comprising a ball sized to engage the gripping mechanism.

5. The locking system of claim 4, wherein the ball is configured to cause the gripping mechanism to expand to the second circumference when engaged with the gripping mechanism.

6. The locking system of claim 4, wherein the bait plunger further comprises at least one of a ferromagnetic metal and a paramagnetic metal.

7. The locking system of claim 3, further comprising a magnetic instrument having a circumference less than the first circumference, the magnetic instrument configured to facilitate removal of the bait device from the inner shaft.

8. The locking system of claim 7, further comprising an unlocking device adapter configured to bypass the key disabling device and access the locking mechanism upon removal of the bait device from the inner shaft.

9. The locking system of claim 8, wherein the unlocking device adapter further comprises an adapter pin configured to engage the locking mechanism.

10. The locking system of claim 9, wherein the unlocking device adapter engages the locking mechanism via a reverse threaded aperture coupled to the locking mechanism via a first end of the adapter pin extended through the inner sleeve.

11. The locking system of claim 10, wherein an opposing end of the unlocking device adapter is configured to engage another key, the unlocking device adapter being further configured to allow operation of the locking mechanism by the other key.

12. The locking system of claim 11, wherein the opposing end of the unlocking device further comprises another ball configured to engage the a gripper mechanism of the other key.

13. The locking system of claim 3, further comprising a locking ring configured to secure a utility meter.

14. A locking system, comprising:

a cylindrical barrel lock having a first end with an aperture, the cylindrical barrel lock having an inner shaft;

at least one locking ball aperture configured to accept at least one respective locking ball, the at least one locking ball aperture extending through the inner shaft and positioned along a surface of the cylindrical barrel lock, the at least one locking ball configured to extend through the at least one locking ball aperture;

a locking mechanism configured to cause the at least one respective locking ball to be positioned in a locked position and an unlocked position; and a key disabling device positioned within the inner shaft, the key disabling device configured to perform at least one of: disabling of a target key inserted into the aperture or capturing of the target key inserted into the aperture, wherein the key disabling device further comprises an aperture configured to accept a first key and a key defacing mechanism configured to damage at least a portion of the first key upon insertion of the first key into the inner shaft, the key defacing mechanism further comprises a lock nut positioned in the inner shaft, the lock nut concave relative to the first end of the cylindrical barrel lock, the lock nut further having an aperture circumference similar to a first key circumference, wherein the lock nut is configured to allow insertion of the key through the lock nut and restrict extraction of the key from the lock nut.

15. The locking system of claim 14, wherein the locking mechanism further comprises a locking cam configured engage a second key, the second key having a second key circumference that is less than the first key circumference.

16. The locking system of claim 15, wherein the locking cam causes the at least one respective locking ball to be positioned in a locked position and an unlocked position by rotation of the locking cam, the locking cam further comprises an elliptical cross-section.

17. The locking system of claim 14, wherein the key defacing mechanism further comprises a conical locking wedge configured to convert a removal force into a clamping force.

18. The locking system of claim 14, wherein the key defacing mechanism further comprises at least one locking cam configured to convert a removal force into a lateral force, the lateral causing the locking cam to damage the target key.

* * * * *